US011198827B2

(12) United States Patent
Molotoka et al.

(10) Patent No.: US 11,198,827 B2
(45) Date of Patent: Dec. 14, 2021

(54) SOLVENT DEWAXING WITH SOLVENTS NEAR MISCIBILITY LIMIT

(71) Applicant: ExxonMobil Research and Engineering Company, Annandale, NJ (US)

(72) Inventors: Ilona Molotoka, Baytown, TX (US); James W. Gleeson, Magnolia, TX (US); Joshua J. Matthews, Hankamer, TX (US); Kristen L. Sullivan, Stewartsville, NJ (US); Jude J. Eziashi, Cambridge, MA (US); David Killgore, Cleveland, TX (US); Jon D. Lachapelle, Missouri City, TX (US); Gaither M. Phillips, Spring, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 16/782,147

(22) Filed: Feb. 5, 2020

(65) Prior Publication Data

US 2020/0263099 A1 Aug. 20, 2020

Related U.S. Application Data

(60) Provisional application No. 62/806,998, filed on Feb. 18, 2019.

(51) Int. Cl.
*C10G 73/02* (2006.01)
*C10G 73/22* (2006.01)

(52) U.S. Cl.
CPC ..... *C10G 73/025* (2013.01); *C10G 73/22* (2013.01)

(58) Field of Classification Search
CPC .... C10G 21/003; C10G 73/025; C10G 73/10; C10G 73/12; C10G 73/22; C10G 2300/202
See application file for complete search history.

(56) References Cited

U.S. PATENT DOCUMENTS 3,681,230 A * 8/1972 Eagen et al. ..... C10G 73/06 208/33
4,088,565 A * 5/1978 Watts ..... C10G 73/06 208/33
4,375,403 A 3/1983 Harrison et al.
(Continued)

OTHER PUBLICATIONS

Sequeira, "Lubricant Base Oil and Wax Processing" (1994) CRC Press LLC, p. 171.

*Primary Examiner* — Brian A McCaig
(74) *Attorney, Agent, or Firm* — Scott F. Yarnell

(57) ABSTRACT

Systems and methods are provided for performing solvent dewaxing using a dewaxing solvent that is not fully miscible with the feed being dewaxed. It has been unexpectedly discovered that by operating with a ketone solvent mixture that is beyond the miscibility limit by a small amount, the rate of solvent dewaxing can be substantially increased. Additionally, the difference between the filtration temperature during solvent dewaxing and the pour point of the resulting dewaxed product is unexpectedly reduced. The dewaxing solvent beyond the miscibility limit can correspond to, for example, a solvent mixture where the weight percent of methyl ethyl ketone is beyond the miscibility limit by 0.1 vol % to 5.0 vol %.

20 Claims, 8 Drawing Sheets

(56) References Cited

U.S. PATENT DOCUMENTS 4,444,648 A * 4/1984 West ..... C10G 73/06
208/33
4,451,353 A * 5/1984 Briens ..... C10G 73/04
208/33

* cited by examiner

SOLVENT DEWAXING WITH SOLVENTS NEAR MISCIBILITY LIMIT

CROSS-REFERENCE TO RELATED APPLICATIONS

This application claims priority to U.S. Provisional Application No. 62/806,998 filed Feb. 18, 2019, which is herein incorporated by reference in its entirety.

FIELD

Systems and methods are provided for production of lubricant oil base stocks via solvent dewaxing using combinations of ketone solvents near the miscibility limit for the solvent in the dewaxing feed.

BACKGROUND

Solvent dewaxing continues to be a commercially important method for production of lubricant base oils. In many instances, the solvent dewaxing is performed using ketone based solvents, such as combinations of methyl ethyl ketone with either methyl isobutyl ketone or toluene. The solvent is mixed an oil feed to separate a wax phase from the mixed solvent and oil phase.

Conventionally, it is believed to be important to select a solvent that does not result in creation of an additional third oil phase during dewaxing. Conventionally, it is believed that if a partially immiscible solvent is used for dewaxing, the immiscible solvent will result in a decrease in the filtration rate, an increase in the oil content in the wax, and a reduction in the dewaxed oil yield. See, for example, A. Sequeira, "Lubricant Base Oil and Wax Processing", Marcel Dekker, New York, p. 171 (1994).

Although conventional solvent dewaxing can be effective, the rate of dewaxing is limited, due in part to limitations in the ability to pass the oil phase through the dewaxing filter without disrupting the resulting wax filter cake and/or without damaging the membrane that supports the filter cake. It would be desirable to develop methods for improving the rate of solvent dewaxing while maintaining or improving on current levels of wax separation from a feed.

U.S. Pat. No. 4,375,403 describes a method for solvent dewaxing. An immiscible liquid is used as a heat exchange fluid to cool the feed to the dewaxing temperature. The immiscible liquid is separated from the feed prior to performing dewaxing.

SUMMARY

In various aspects, a method for performing solvent dewaxing is provided. The method can include mixing a dewaxing solvent comprising a first solvent and a second solvent with a feedstock at a volume ratio of dewaxing solvent to feedstock of 1.5:1 to 6:1 to form a dewaxing mixture. In some aspects, the first solvent can correspond to methyl ethyl ketone. In some aspects, the second solvent can correspond to toluene, methyl isobutyl ketone, or a combination thereof. The method can further include performing solvent dewaxing on the dewaxing mixture at a filtration temperature to form dewaxed oil and wax cake. In various aspects, the amount of the first solvent (such as methyl ethyl ketone) in the dewaxing solvent can be beyond a miscibility point at the filtration temperature. For example, the amount of the first solvent can be beyond the miscibility point at the filtration temperature by 0.1 vol % to 5.0 vol %.

DETAILED DESCRIPTION

All numerical values within the detailed description and the claims herein are modified by "about" or "approximately" the indicated value, and take into account experimental error and variations that would be expected by a person having ordinary skill in the art.

Overview

In various aspects, systems and methods are provided for performing solvent dewaxing using a dewaxing solvent that is not fully miscible with the feed being dewaxed. It has been unexpectedly discovered that by operating with a ketone solvent mixture that is beyond the miscibility limit by a small amount, the rate of solvent dewaxing can be substantially increased. Additionally, the difference between the filtration temperature during solvent dewaxing and the pour point of the resulting dewaxed product is unexpectedly reduced. The dewaxing solvent beyond the miscibility limit can correspond to, for example, a solvent mixture where the weight percent of methyl ethyl ketone is beyond the miscibility limit by 0.1 vol % to 5.0 vol %.

Figure 1:
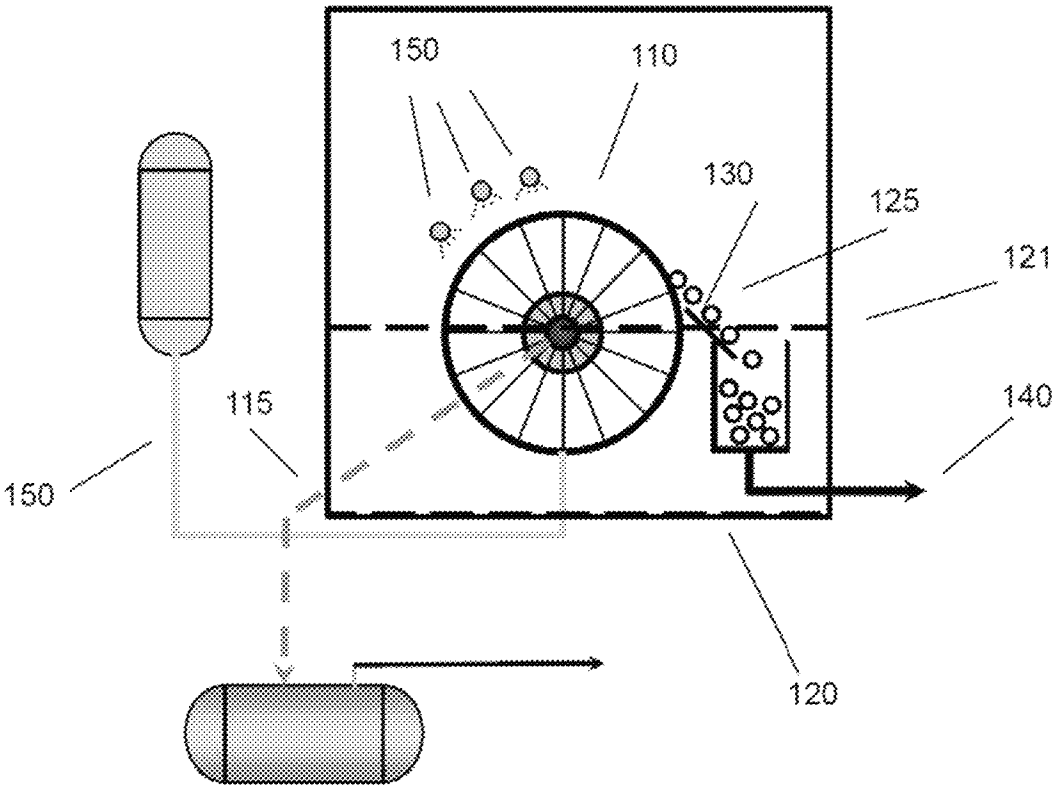
FIG. 1 shows an example of a solvent dewaxing apparatus.

FIG. 1 shows an example of a filter and associated components for performing solvent dewaxing. In FIG. 1, a feed 105 corresponding to a mixture of dewaxing solvent and feedstock (such as a raffinate feed) is delivered to a filter drum 110 is enclosed within a vat 120. Level line 121 indicates the level of oil plus solvent plus wax within vat 120. Piping in the interior of the filter drum 110 can be at a reduced pressure relative to the exterior of the filter drum 110, so that a liquid phase portion 115 of the mixture of oil and solvent can be drawn through the filter and into the interior piping of the filter drum 110. The liquid phase portion 115 of the mixture of oil and solvent, corresponding to a filtrate, can then be separated (not shown) to recover the desired dewaxed oil product from the solvent. Dewaxing solvents typically have a low boiling point, so distillation type separations can be suitable. A solid wax phase can accumulate to form a wax cake 125 on the exterior of filter drum 110. As the drum rotates, the accumulated wax cake 125 can be removed, such as by using a deflector blade 130, to allow for recovery 140 of the wax. Prior to removing the wax cake 125, the wax cake can be washed 150 using additional solvent to further remove oil from the wax cake. It is noted that when multiple filtration steps are present, multiple filters having multiple wax cakes can be formed. In such aspects, a separate wash temperature (i.e., temperature of the solvent for performing the wash) can optionally be selected for each of the multiple filters. Optionally, one or more of the wash temperatures can be greater than the filtration temperature.

Conventionally, solvent dewaxing corresponds to a two phase process. Prior to entering the vat 120, a raffinate feed is mixed with a suitable solvent, such as a ketone-containing solvent. This results in formation of a slurry of an oil phase (including solvent and raffinate) that contains solid wax particles. The slurry is then passed into the vat to allow for passage of the oil phase through the filter while forming a wax cake on the filter surface. Thus, the slurry includes a single liquid phase.

Conventionally, it is believed that using a solvent and raffinate feed mixture that results in formation of more than one liquid phase would be detrimental to filtration performance and/or dewaxed oil yield. With regard to filtration performance, during conventional operation, it is believed that performing filtration in the presence of more than one liquid phase can potentially create difficulties due overloading the dewaxing filter of one or more filtration stages, due to excess amounts of the heavier liquid phase filling the spaces between the wax particles of the wax cake that accumulates on the filter surface. This can require a reduction in the raffinate feed rate to the unit. Additionally, the additional heavy liquid phase that remains with the wax product can potentially require additional solvent and thus overload the system to recover solvent from the wax. Conventionally, if it is believed or detected that a second liquid phase is present during solvent dewaxing, the condition would be corrected (i.e., returned to fully miscible conditions) by warming the dewaxing slurry, changing to a lighter oil feedstock, and/or modifying the composition of the solvent.

Figure 2:
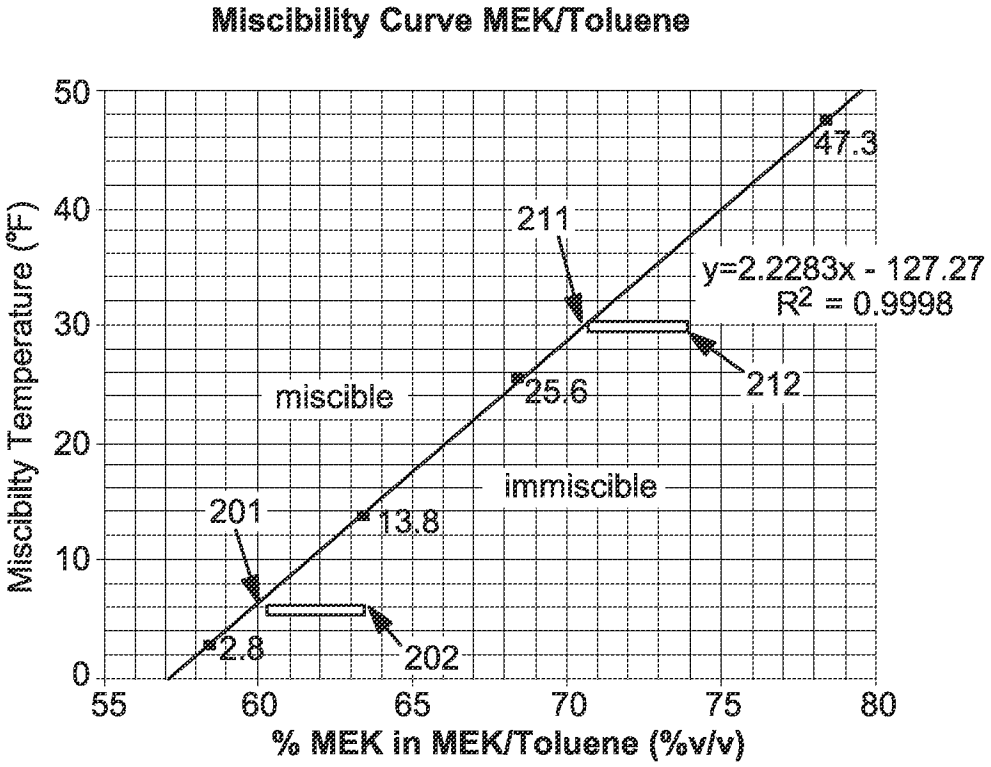
FIG. 2 shows a miscibility curve for a dewaxing solvent based on methyl ethyl ketone and toluene.

One way of determining that a single solvent phase is present is based on a miscibility curve. FIG. 2 shows an example of a miscibility curve. The miscibility curve in FIG. 2 was generated by the following method. First, a bright stock raffinate sample was dewaxed at a filtration temperature of −25° C. (−13° F.) using a solvent corresponding to 10 vol % toluene and 90 vol % methy isobutyl ketone (MIBK). The dilution ratio (by volume) of solvent to raffinate was 4:1. The solvent was then removed from the dewaxed oil by evaporation. The dewaxed oil was then diluted at a 5:1 solvent to oil ratio using a variety of solvent mixtures that included varying ratios of methyl ethyl ketone (MEK) and toluene. Water was also added to match the intended or expected conditions of a desired solvent dewaxing environment. Alternatively, the miscibility curve could be adjusted based on known impact of water. The mixture was then cooled to progressively lower temperatures until it became cloudy. The cloudiness indicates the formation of a second phase within the mixture. The temperature at which the mixture becomes cloudy is the miscibility temperature for that solvent combination relative to the feed. Herein, we refer to the miscibility point as the maximum % MEK at which the solvent and oil are fully miscible at a particular temperature.

FIG. 2 shows the results of the miscibility curve generated by the above method which plots miscibility temperatures against volume % MEK. As shown in FIG. 2, the ratio of MEK to toluene that results in formation of a second phase increases with increasing temperature. For example, as shown at location 201, at a filtration temperature of roughly 6° F. (−14° C.), the miscibility point corresponds to roughly 60 vol % MEK. Location 211 shows that the miscibility point increases to over 70 vol % MEK at a filtration temperature of 30° F. (−1° C.). Based on the miscibility curve, region 202 corresponds to immiscible amounts of MEK that can be beneficial for solvent dewaxing at −14° C. Similarly, region 212 corresponds to amounts of MEK that can be beneficial for solvent dewaxing at −1° C. It is noted that for generation of the above miscibility curve, a deeply dewaxed raffinate was used, so that the observation of cloudiness would correspond to formation of a second oil phase rather than formation of wax solids.

Although the miscibility curve shown in FIG. 2 was developed using a deeply dewaxed raffinate, it is believed that FIG. 2 is generally representative of the miscibility curve for MEK and toluene in conventional types of bright stock feeds to solvent dewaxing. Thus, the miscibility curve shown in FIG. 2 can be used to determine the miscibility of MEK/toluene solvent combinations with feeds to a solvent dewaxing process at various temperatures. Similar miscibility curves can be generated for other types of typical feeds, such as 100N feeds, 600N feeds, or others. Alternatively, in some instances it may be desirable to develop a miscibility curve specific to a feedstock or even specific to a feedstock and volume ratio of solvent to feedstock. Such a miscibility curve based on a feedstock for a given dewaxing solvent can be generated according to the method described above.

It has been discovered that performing solvent dewaxing with a combination of feed and solvent that is beyond the miscibility curve can lead to unexpected benefits in solvent dewaxing rate, as well as an unexpected reduction in the difference between the filtration temperature of the solvent dewaxing apparatus and the resulting pour point of the dewaxed oil. Without being bound by any particular theory, it is believed that operation beyond the miscibility limit results in formation of a first solvent rich phase including a minor amount of oil and a second phase including a larger percentage of oil. It is believed that formation of the second phase including the larger percentage of oil facilitates transport of both phases through the wax cake formed on the filter surface, thus allowing for higher dewaxing rates. Additionally, it is believed that the increase in the amount of ketone can allow for an increase in filtration temperature relative to a desired pour point for the resulting dewaxed oil and/or a decrease in the viscosity of the liquid phase(s). In some aspects, the unexpected benefits can be achieved when using a solvent that is close to the miscibility limit for the solvent in the raffinate. For solvents corresponding to a mixture of MEK with a second solvent component, the proximity of the solvent to the miscibility limit can be characterized based on the volume percentage of MEK that is beyond the miscibility limit at the filtration temperature. In some aspects where the solvent is close to the miscibility limit, the amount of MEK beyond the miscibility limit can be 0.1 vol % to 5.0 vol %, or 0.1 vol % to 3.0 vol %. In other aspects, the amount of MEK can be beyond the miscibility limit by 0.1 vol % to 15 vol %, or 0.1 vol % to 10 vol %.

In some optional aspects, a dewaxing aid can be used to further enhance the solvent dewaxing process while operating with a solvent that is beyond the miscibility limit. Including a dewaxing aid appears to provide a further synergistic benefit for increasing the filtration rate. The amount of dewaxing aid can be any convenient amount, such as 50 vppm to 2000 vppm in the raffinate feedstock for dewaxing, or 100 vppm to 1000 vppm, or 50 vppm to 500 vppm, or 100 vppm to 500 vppm. Poly(alkyl methacrylate) is an example of a suitable dewaxing aid.

It is noted that operating with a solvent beyond the miscibility limit for a feed can result in a reduction in the dewaxed oil yield. Without being bound by any particular theory, it is believed that the second oil phase can form a viscous phase within the wax cake, so that the wax cake retains a higher amount of oil. This additional oil in the wax cake can be recovered, for example, by increasing the temperature of the cold solvent used to wash the wax filter cake. Increasing the cold wash temperature can return the solvent to fully miscible conditions with the feed, thus allowing the added viscous phase in the wax cake to be recovered prior to removal of the wax from the filter. If excessively high wash temperatures are used, the pour point of the dewaxed oil may increase to an unacceptable level.

Configuration Overview

The feedstocks suitable for dewaxing with a solvent beyond the miscibility point can correspond to any type of feedstock for solvent dewaxing that is suitable for forming heavier lubricant base stocks. In some aspects, the feedstock can correspond to a feedstock with a kinematic viscosity at 100° C. of 3.0 cSt or more, or 6.0 cSt or more, or 8.0 cSt or more, or 12 cSt or more, or 16 cSt or more, or 20 cSt or more, such as up to 40 cSt or possibly still higher. Additionally or alternately, the feedstocks can correspond to feedstocks that, after solvent dewaxing and any optional hydrofinishing, result in a dewaxed oil having a viscosity index of 40 or more, or 80 or more, or 95 or more, such as up to 120 or possibly still higher.

Any waxy petroleum oil stock or distillate fraction thereof may be dewaxed employing the improvement of this invention. Illustrative, but nonlimiting examples of such stocks are (a) distillate fractions that have a boiling range within the broad range of about 500° F. (260° C.) to about 1300° F. (~700° C.), with preferred stocks including the lubricating oil and specialty oil fractions boiling within the range of between 550° F. (288° C.) and 1200° F. (~650° C.), (b) bright stocks and deasphalted resids having an initial boiling point above about 800° F. (~425° C.) and (c) broad cut feed stocks that are produced by topping or distilling the lightest material off a crude oil leaving a broad cut oil, the major portion of which boils above 500° F. (260° C.) or 650° F. (343° C.). Additionally, any of these feeds may be hydrocracked prior to distilling, dewaxing or topping. The distillate fractions may come from any source such as the paraffinic crudes obtained from Aramco, Kuwait, the Pan Handle, North Louisiana, etc., naphthenic crudes, such as Tia Juana, Coastal crudes, etc., as well as the relatively heavy feed stocks, such as bright stocks having a boiling range of 1050° F.+(566° C.+), and synthetic feed stocks derived from Athabasca Tar Sands, etc.

According to various embodiments solvent dewaxing involves mixing the raffinate from a solvent extraction unit with chilled dewaxing solvent to form an oil-solvent solution. Precipitated wax is thereafter separated by, for example, filtration. The temperature and solvent are selected so that the oil is dissolved by the chilled solvent while the wax is precipitated.

An example of a suitable solvent dewaxing process involves the use of a cooling tower where solvent is prechilled and added incrementally at several points along the height of the cooling tower. The oil-solvent mixture is agitated during the chilling step to permit substantially instantaneous mixing of the prechilled solvent with the oil. The prechilled solvent is added incrementally along the length of the cooling tower so as to maintain an average chilling rate at or below 10° F. (~5° C.) per minute, usually between 1° F. to 5° F. per minute (~0.5° C. to ~3° C. per minute). The final temperature of the oil-solvent/precipitated wax mixture in the cooling tower can be between 0 and 50° F. (−17.8 to 10° C.). The mixture may then be sent to a scraped surface chiller to chill further and crystallize more wax. In another example, all chilling may be done with scraped surface exchangers and chillers.

Any solvent useful for dewaxing waxy petroleum oils may be used in the process of this invention. Representative examples of such solvents are (a) the aliphatic ketones having from 3 to 6 carbon atoms, such as acetone, methyl ethyl ketone (MEK) and methyl isobutyl ketone (MIBK), and (b) lower molecular weight autorefrigerant hydrocarbons, such as ethane, propane, butane and propylene when mixed with the aforesaid ketones, as well as mixtures of the foregoing and mixtures of the aforesaid ketones and/or hydrocarbons with aromatics, such as single-ring aromatics (e.g., benzene, xylene and toluene). In addition, halogenated, low molecular weight hydrocarbons such as the $C_2$-$C_4$ chlorinated hydrocarbons, e.g., dichloromethane, dichloroethane, methylene chloride and mixtures thereof, may be used as solvents either alone or more commonly in admixture with other halogenated hydrocarbons or with any of the aforementioned solvents. Another solvent that may be used in admixture with any of the other solvents is N-methyl-2-pyrrolidone (NMP).

Specific examples of suitable solvents include mixtures of MEK and MIBK, mixtures of MEK and toluene, and mixtures of propylene and acetone. Preferred solvents are mixtures containing one or more ketones. Particularly preferred solvents include mixtures of MEK and MIBK and mixtures of MEK and toluene. In some aspects, at least one component of the dewaxing solvent can correspond to methyl ethyl ketone (MEK).

In general, the amount of solvent added can be sufficient to provide a) a liquid/solid weight ratio between the range of 5:1 to 20:1 at the dewaxing temperature, or 10:1 to 15:1, and b) a solvent/oil volume ratio between 1.5:1 to 6:1, or between 2.5:1 to 5:1. The solvent dewaxed oil is, according to various embodiments, dewaxed to an intermediate pour point. Suitable pour points can be 10° C. or less, or 5° C. or less, or 0° C. or less, or −5° C. or less, such as down to −25° C. or possibly still lower.

Any suitable filtration method known in the art for separating wax from the slurry can be used. Preferred means include continuous rotary drum vacuum or pressure filtration. Continuous rotary drum filters are well known and used in the petroleum industry for wax filtration. Models specifically designed and constructed for filtering wax from lube oil fractions are commercially available from manufacturers such as FL Smidth and formerly by Dorr Oliver and Eimco. As an example, a rotary drum vacuum filter comprises a horizontal, cylindrical drum, the lower portion of which is immersed in a wax slurry, a filter medium or cloth covering the horizontal surface of the drum, means for applying both vacuum and pressure thereto, and means for washing and removing wax cake deposited on the cloth as the drum continuously rotates around its horizontal axis. In these filters the drum is divided into compartments or sections, each section being connected to a rotary (trunnion) valve by piping within the drum and then to a discharge head. The wax slurry is fed into the filter vat and as the drum rotates, the faces of the sections pass successively through the slurry. In a vacuum drum filter, a vacuum is applied to the sections as they pass through the slurry, thereby drawing oily filtrate through the filter medium and depositing wax therein in the form of a cake. As the cake leaves the slurry, the internal piping and equipment downstream (such as a receiver drum) contains only filtrate which is removed therefrom by the continued application of vacuum, along with wash solvent which is evenly distributed or sprayed on the surface of the cake, thereby forming a solvent-rich wash filtrate. Finally, the washed wax cake is removed by a scraper which is assisted by means of blow gas applied to each section of the drum as it rotates and reaches the scraper. In a pressure filter, the solvent contains an autorefrigerant, which, by virtue of its relatively high vapor pressure, is sufficient to apply a pressure differential across the filter surface of the drum, thereby eliminating the need for applying a vacuum thereto. By making appropriate adjustments to the trunnion valve, the wash filtrate may be collected separately from the oily filtrate.

In various aspects, filtration temperatures for the waxy slurries range from −30° F. to +25° F. (~−35° C. to −4° C.), or from −10° F. to +15° F. (~−23.3° C. to −9.4° C.) for ketone solvents. In various aspects, filtration temperatures for the waxy slurries range from −45° F. to −10° F. (~−42° C. to −12.2° C.) or from −35° F. to −15° F. (~−37.2° C. to −26.1° C.) for autorefrigerant solvents such as propylene/acetone. In some aspects, the filtration temperature can depend primarily on the pour point requirement of the dewaxed oil and the solvent composition. The wash solvent can be at or slightly below the filtration temperature. Optionally, in some aspects, the wash solvent for at least one filtration stage can be at a wash temperature greater than the filtration temperature. In such optional aspects, the wash temperature can be greater than the filtration temperature by 2° C. to 15° C., or 2° C. to 10° C., or 2° C. to 5° C.

In some aspects, the total filtrate can correspond to an oil filtrate and a wash filtrate. The oily filtrate corresponds to the filtrate that passes through the filter from the vat containing the solvent and feed mixture, while the wash filtrate corresponds to the additional oil that passes through the filter during the cold washing of the wax cake. The combined filtrate is sent to solvent and oil recovery and, additionally, may also be recycled back to filtration wherein it is combined with the waxy slurry being fed to the wax filters. In various aspects, the combined filtrate recycle ranges from 0 LV % to 300 LV % of the oily feed entering the dewaxing zone, or 0 LV % to 100 LV %, or 0 LV % to 50 LV %. This does not mean that the combined filtrate is first recycled and then sent to oil and solvent recovery. Initially, during startup of the dewaxing operation, a portion of the combined filtrate that would normally be sent to oil and solvent recovery is instead diverted to the recycle loop to build up the volume of filtrate required to operate same. Once the combined filtrate recycle loop contains the required volume of filtrate and has reached a continuous, steady state condition, although some of the combined filtrate from the first stage of filtration will continue to be diverted to recycle, it is no longer at the expense of the volumetric flow rate of same to the oil and solvent separation and recovery operations.

Figure 3:
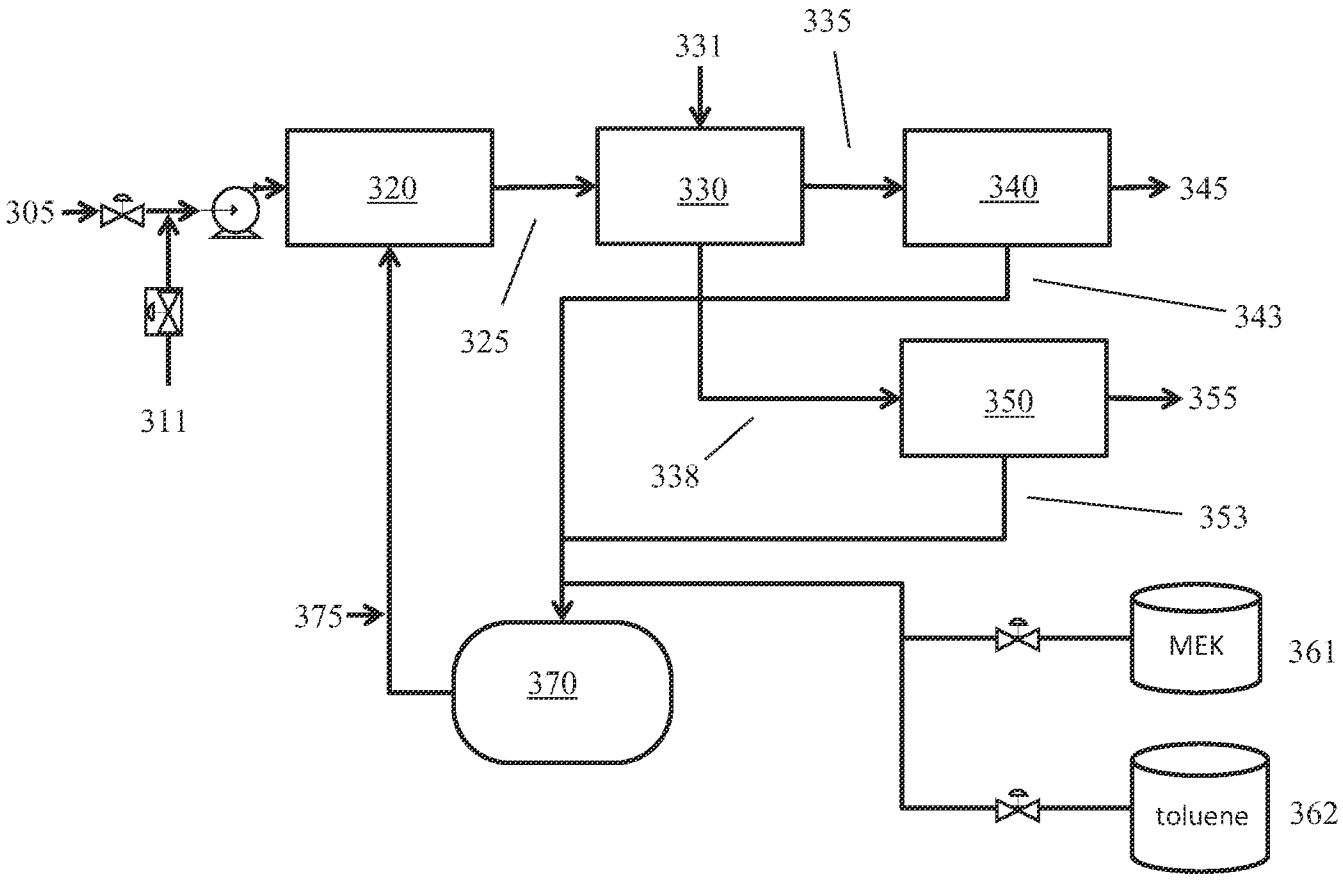
FIG. 3 shows an example of a process flow for performing solvent dewaxing.

FIG. 3 shows an overview of how operation with a solvent beyond the miscibility limit can be integrated with a general solvent dewaxing configuration. In the process flow shown in FIG. 3, a waxy feed 305 is optionally combined with a dewaxing aid 311 prior to being introduced into feed chilling and mixing stage 320. The waxy feed 305 is mixed with solvent 375 from solvent storage 370. The chilling and mixing stage 320 chills the mixture of solvent and feed to produce a slurry 325 containing wax particles.

The slurry 325 is passed to one or more filtration stages 330 for separation of wax from the remaining solvent and oil mixture. One or more additional cold washes of solvent 331 can be passed into the one or more filtration stages 330. The filtration stages 330 can generate a dewaxed oil and solvent mixture 335, as well as a wax product 338.

The dewaxed oil and solvent mixture 335 can be passed into a solvent recovery stage 340, such as a distillation stage, to separate dewaxed oil 345 from solvent 343. The separated solvent 343 can be returned to solvent storage 370 for further use. The wax product 338 can be passed to one or more de-oiling stages 350 to allow for recovery of solvent 353 from wax 355. As needed, additional solvent can be added to the system, such as additional MEK 361 and/or additional toluene 362.

The configuration shown in FIG. 3 is suitable for operation with a solvent beyond the miscibility point. For example, the ratio of additional MEK 361 and additional toluene 362 that is introduced into solvent storage 370 can be modified to produce a solvent that is not fully miscible with waxy feed 305. This can allow a not fully miscible solvent to be introduced into chilling and mixing stage 320. The resulting slurry, including solvent beyond the miscibility point, can then be passed into the filtration stage(s) 330. Additionally, in order to improve the yield of dewaxed oil, the temperature of the cold wash(es) 331 can be increased relative to the filtration temperature in the filtration stage(s) 330.

Example 1: Variations in Amounts of MEK and Dewaxing Aid During Solvent Dewaxing A solvent extracted deasphalted oil was used as a feed for solvent dewaxing under various conditions, including varying amounts of MEK in the dewaxing solvent and varying amounts of a dewaxing aid. The solvent dewaxing apparatus corresponded to a rotating drum filter with polyester filter cloth. The solvent system was a mixture of MEK and toluene, with poly(alkyl methacrylate) optionally included as a dewaxing aid. The volume ratio of solvent to feed was 5.0:1. The filtration was performed at a temperature of 6.1° F. (~−14.4° C.). Chilling of the feed was accomplished by mixing the feed in a chilled environment, followed by contacting the mixed feed with propane refrigerated scraped surface exchangers. Unless specifically noted, all of the results shown included 70 vppm to 100 vppm of a dewaxing aid.

In this example, different filters were used for some of the tests, which had corresponding different filter speeds. The various results were harmonized using the relationship (rate 1/rate 2)=(filter speed 1/filter speed 2)$^{1/2}$.

Figure 4:
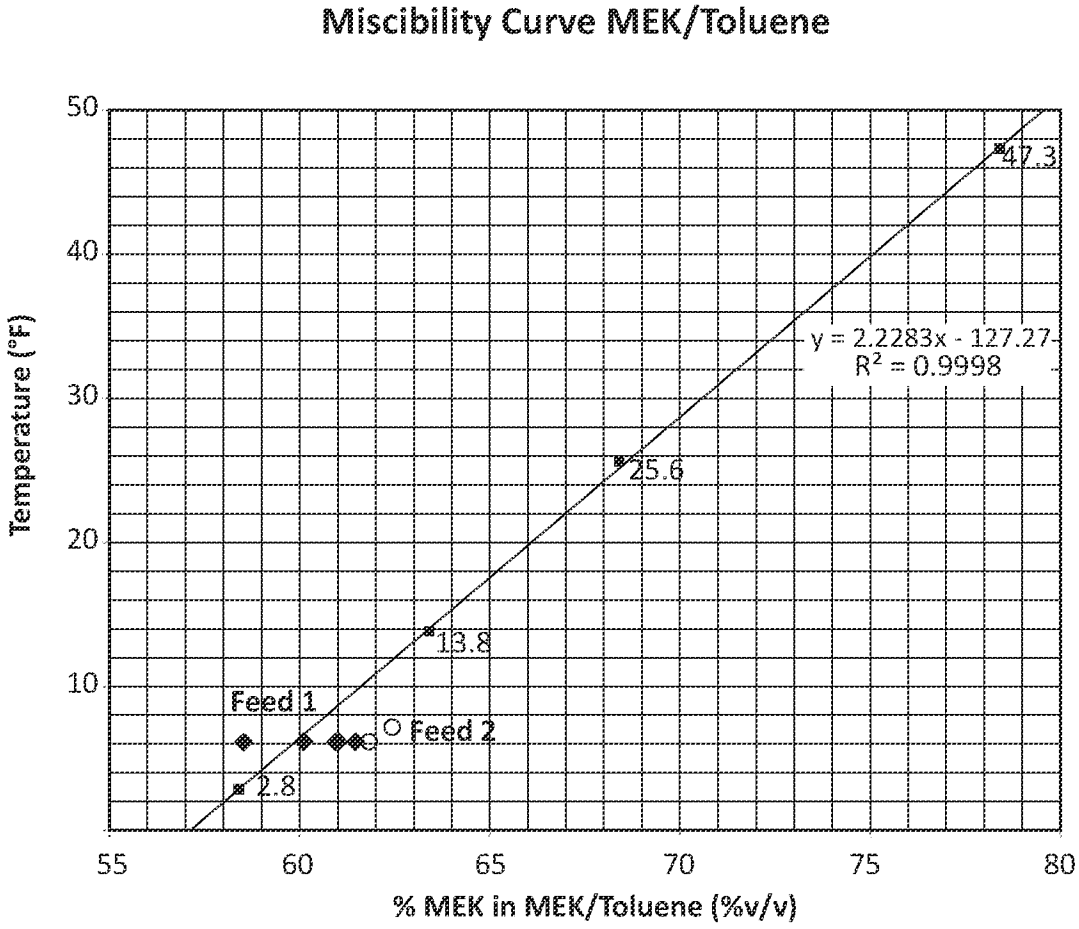
FIG. 4 shows test conditions for testing of various dewaxing solvents relative to the miscibility curve for a feed.

FIG. 4 shows the combinations of MEK and toluene that were used to make the dewaxing solvents for the solvent dewaxing. The solvents are shown on the miscibility chart from FIG. 2. The amounts of MEK in the solvent system were selected by using the miscibility temperature in the table that corresponds to the filtration temperature for solvent dewaxing. As shown in FIG. 4, one test condition included a solvent with 58.5 vol % MEK (which is within the miscibility point). In other words, this corresponded to the baseline condition, as this solvent is on the conventional side of the miscibility curve. The remaining test conditions corresponded to amounts of MEK that were beyond the miscibility point at the filtration temperatures of either 6.1° F. (~−14.4° C.) or 7.2° F. (~−13.8° C.). The additional test conditions included between 60.0 vol % and 62.0 vol % MEK at the filtration temperature of −14.4° C., and 62.5 vol % MEK at −13.8° C. Thus, the additional test conditions ranged from having MEK amounts of 0.1 vol % to 2.0 vol % beyond the miscibility point.

Figure 5:
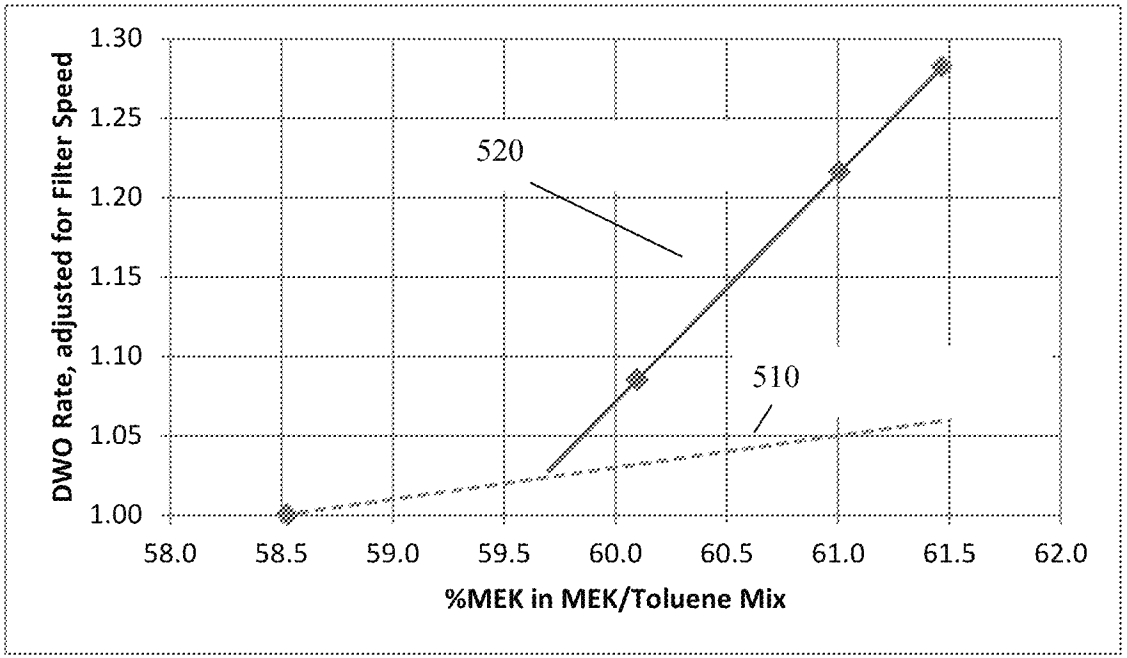
FIG. 5 shows the rate of dewaxed oil production relative to the amount of MEK in the dewaxing solvent for various dewaxing solvent compositions.

FIG. 5 shows the dewaxed oil rate (adjusted to account for filter speed, and normalized relative to a baseline data point) relative to the amount of MEK in the solvent when operating at a filtration temperature of −14.4° C. In FIG. 5, the data point at 58.5 vol % MEK corresponds to a conventional operation point in the miscible region. This data point is used as a baseline, so the dewaxed oil rate at 58.5 vol % MEK corresponds to a dewaxed oil rate of 1.0. The trend line 510 passing through the data point at 58.5 vol % shows the change in dewaxed oil rate that would be expected based on conventional operation. As shown in FIG. 5, increasing the amount of MEK would be expected conventionally result in small corresponding increases in the dewaxed oil rate. However, because the additional data points in FIG. 5 are beyond the miscibility point, a substantially higher increase in the dewaxed oil rate was observed, as further illustrated by trend line 520. Using the data point at 58.5 vol % as a baseline value, increasing the MEK in the solvent to 61.5 vol % would be expected to yield an increase in dewaxed oil rate of roughly 5%. By contrast, just increasing the MEK amount to 60.1 vol % resulted in an increase in the dewaxed oil rate of nearly 10%, with a nearly 30% increase observed at 61.5 vol % MEK. This unexpected increase in the dewaxed oil rate can allow a solvent dewaxing unit to process substantially larger volumes of raffinate at the same conditions.

Figure 6:
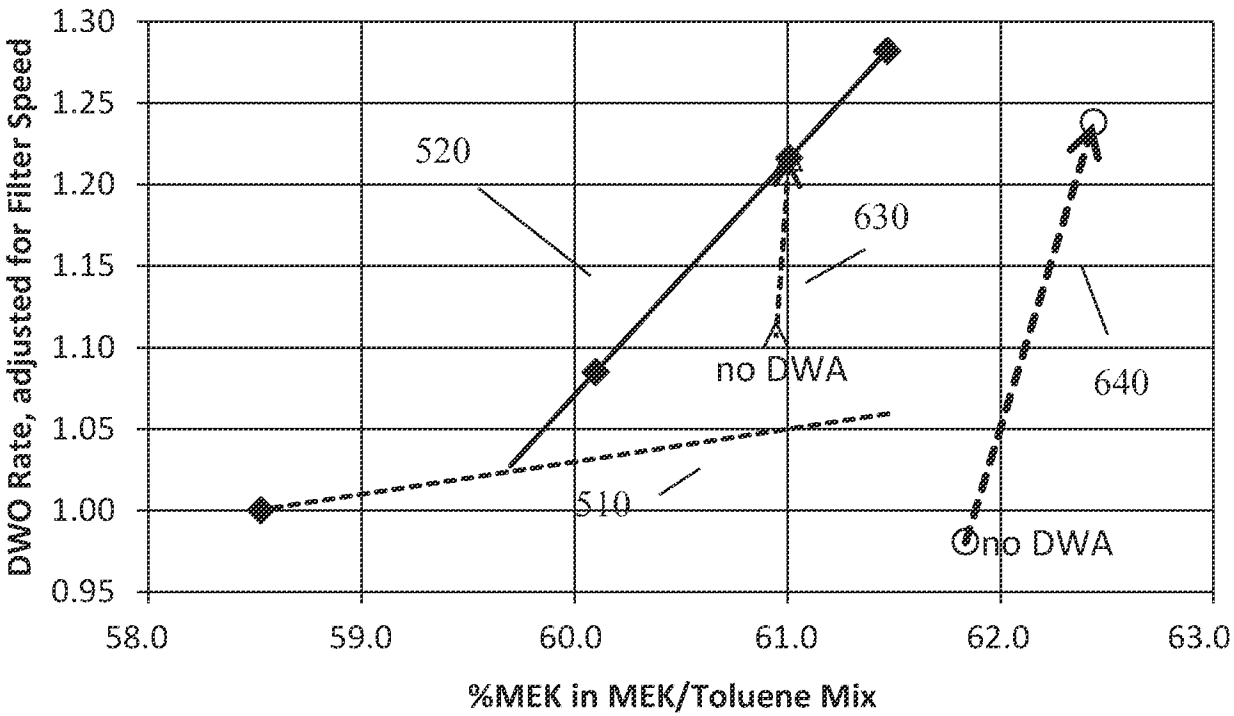
FIG. 6 shows the rate of dewaxed oil production relative to the amount of MEK in the dewaxing solvent for various dewaxing solvent compositions.

FIG. 6 shows the data points from FIG. 5, but further includes additional data to provide a comparison between operation with and without a dewaxing aid. Trend line 630 shows the difference between performing dewaxing with and without 100 vppm of a dewaxing aid at roughly 61 vol % MEK and a filtration temperature of −14.4° C. (The data point with no dewaxing aid is labeled.) As shown in FIG. 6, the presence of the dewaxing aid increased the dewaxed oil rate by roughly an additional 10 vol %. Trend line 640 provides a similar comparison for performing dewaxing with and without 350 vppm of a dewaxing aid at a filtration temperature of −13.8° C. and 62.5 vol % MEK and with a different bright stock raffinate feed. As shown in FIG. 6, the presence of the dewaxing aid increased the dewaxed oil rate by roughly 25%. It is noted that the baseline value in FIG. 6 also includes a dewaxing aid. Thus, the apparent dewaxed oil rate of less than 1.0 for the data point at 62.5 vol % MEK without a dewaxing aid is based on a comparison with dewaxing under miscible conditions with roughly 100 vppm of a dewaxing aid. It is expected that if the baseline condition (58.5 vol % MEK, −14.4° C. filtration temperature) was used to perform dewaxing without a dewaxing aid, the dewaxed oil rate under the conditions beyond the miscibility point would be higher than the dewaxed oil rate under the miscible conditions.

Figure 7:
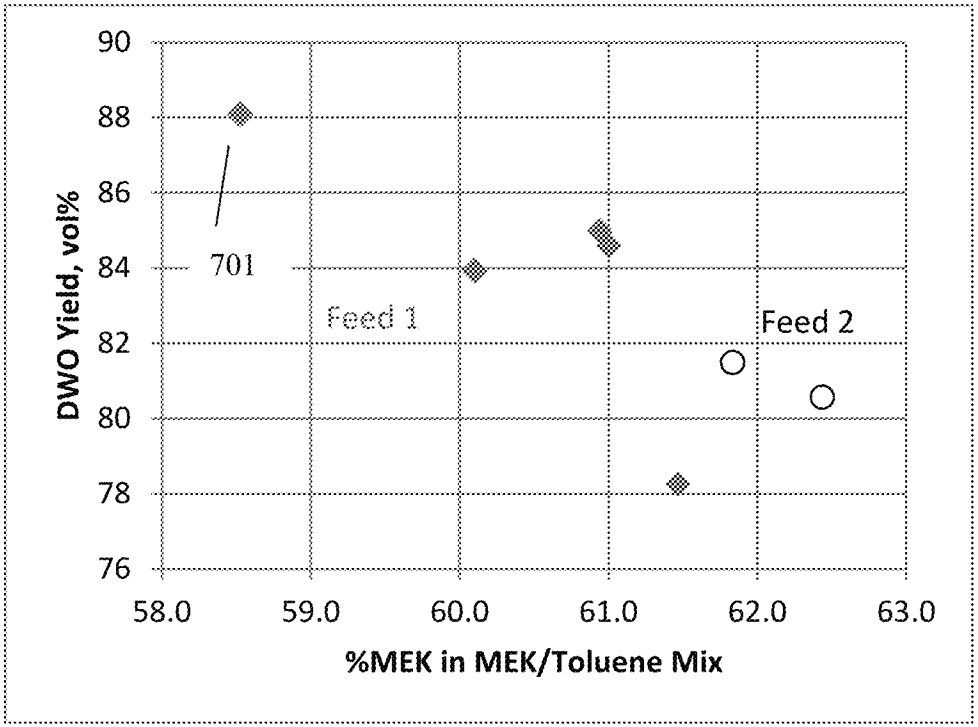
FIG. 7 shows dewaxed oil yield relative to the amount of MEK in the dewaxing solvent for various dewaxing solvent compositions.

Although the dewaxed oil rate can be increased by operating beyond the miscibility point, the yield of dewaxed oil can be reduced. FIG. 7 shows the dewaxed oil yield for all of the test conditions shown in FIG. 6. The baseline point at 58.5 vol % MEK is identified as point 701. As shown in FIG. 7, increasing the amount of MEK beyond the miscibility point appears to decrease the dewaxed oil yield by 2 vol % to 10 vol %. However, it was discovered that this loss in yield could be at least partially mitigated by increasing the cold wash temperature. Conventionally, the cold wash temperature during solvent dewaxing can be similar to or possibly lower than the filtration temperature. By increasing the cold wash temperature, the solvent can be returned to miscible conditions, which can then allow excess oil trapped in the wax cake to be incorporated into the oil product as part of the wash filtrate. In aspects where multiple filtration stages are used, the increase in the cold wash temperature can optionally be used for the second filtration stage. Without being bound by any particular theory, when operating beyond the miscibility point, it appears that a portion of the oil-rich phase can become trapped in the wax cake. Increasing the cold wash temperature can assist with recovering this additional oil from the wax cake.

Table 1 shows a comparison of four solvent dewaxing tests performed at a filtration temperature of roughly 8.1° F. (−13.3° C.). In Table 1, two of the tests were performed using solvents with an MEK amount of roughly 61.4 vol %. This is just beyond the miscibility point at 8.1° F. Two additional tests were performed with an MEK about of roughly 62.4 vol %, which is further from the miscibility point. The cold wash temperatures were also varied. For the first two tests, the variation in cold wash temperature provided the difference between being beyond the miscibility point (−14.7° C.) and being in the miscible region (−12.8° C.). For the second two tests, both cold wash temperatures were beyond the miscibility point.

TABLE 1

Variation in Cold Wash Temperature

| Case | Relative Feed rate | $2^{nd}$ stage cold wash temperature | Filtration temperature | Vol % MEK | Dewaxed oil yield (vol %) |
|---|---|---|---|---|---|
| 1 | 1.00 | −14.7° C. | −13.3° C. | 61.3 | 86.3 |
| 2 | 1.00 | −12.8° C. | −13.2° C. | 61.4 | 87.6 |
| 3 | 1.06 | −19.9° C. | −13.2° C. | 62.3 | 85.0 |
| 4 | 1.01 | −17.0° C. | −13.2° C. | 62.4 | 84.8 |

As shown in Table 1, varying the cold wash temperature from below the miscibility point to above the miscibility point resulted in an increase in dewaxed oil yield of more than 1.0 vol %. By contrast, variation in the cold wash temperature between values beyond the miscibility point had little or no impact on yield.

Figure 8:
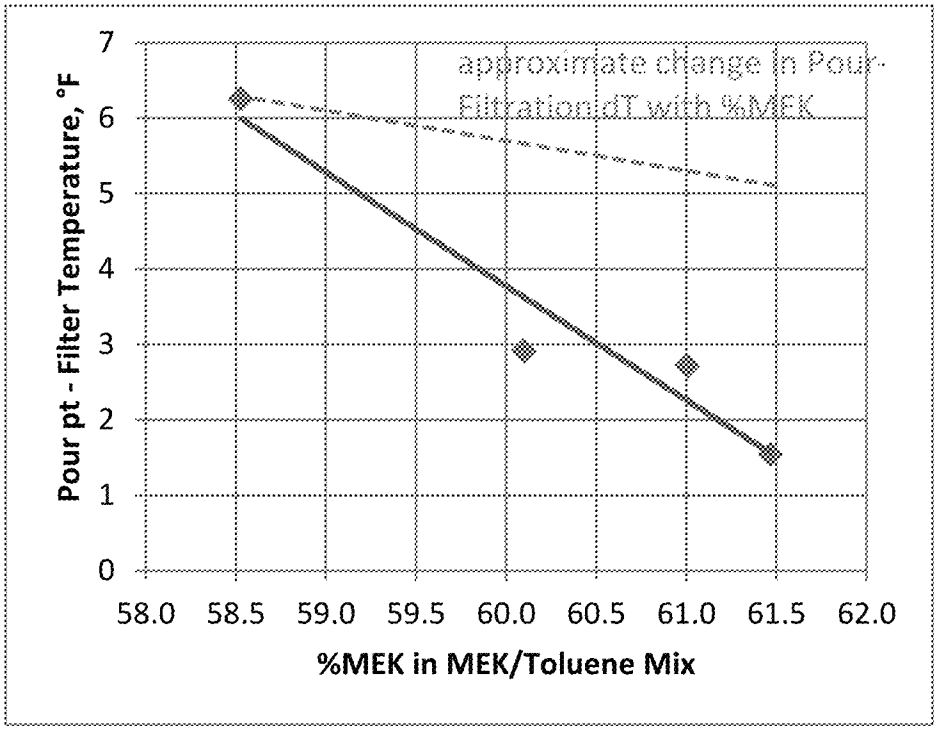
FIG. 8 shows the difference between pour point and filtration temperature versus the amount of MEK in the dewaxing solvent for dewaxed oil produced using various dewaxing solvent compositions.

Another benefit of operating beyond the miscibility point can be observed in the pour point of the resulting dewaxed oil. Conventionally, there can be a substantial gap between the filtration temperature in the dewaxing process and the resulting pour point of the dewaxed oil. In various aspects, the filtration temperature is higher than the resulting pour point by around 5.0° F. (~2.7° C.) or more. FIG. 8 shows an example of this, where the data point at 58.5 vol % MEK (miscible conditions) resulted in a pour point that was roughly 6.0° F. (~3.3° C.) greater than the filtration temperature. It was unexpectedly observed that at MEK amounts of 60.1 vol % or more (beyond the miscibility point), the difference between the pour point and filter point was reduced by half or more, so that the difference between the pour point and filter point was 3° F. (~1.7° C.) or less. Thus, operating with a solvent beyond the miscibility limit can reduce the spread between the filtration temperature and the pour point to 2.0° C. or less, or 1.5° C. or less, or 1.0° C. or less. Reducing the spread between the filtration temperature and the pour point of the resulting dewaxed oil can allow solvent dewaxing to be performed under lower chilling severity conditions and/or at higher filtration rates while still achieving a target pour point.

Additional Embodiments

Embodiment 1

A method for performing solvent dewaxing, comprising: mixing a dewaxing solvent comprising a first solvent and a second solvent with a feedstock at a volume ratio of dewaxing solvent to feedstock of 1.5:1 to 6:1 (or 2.5:1 to 5:1) to form a dewaxing mixture; and performing solvent dewaxing on the dewaxing mixture at a filtration temperature to form dewaxed oil and wax cake, an amount of the first solvent in the dewaxing solvent being beyond a miscibility point at the filtration temperature.

Embodiment 2

The method of Embodiment 1, wherein the amount of the first solvent is beyond the miscibility point at the filtration temperature by 0.1 vol % to 5.0 vol % (or 0.1 vol % to 3.0 vol %).

Embodiment 3

The method of any of the above embodiments, wherein the first solvent and the second solvent are selected from aliphatic ketones comprising 3-6 carbons (such as acetone, methyl ethyl ketone, methyl isobutyl ketone, or a combination thereof), autorefrigerant hydrocarbons (such as propylene), $C_2$-$C_4$ chlorinated hydrocarbons (such as dichloromethane, dichloroethane, methylene chloride, or a combination thereof), and single-ring aromatics (such as benzene, toluene, xylene, or a combination thereof).

Embodiment 4

The method of Embodiment 1 or 2, i) wherein the first solvent comprises methyl ethyl ketone, ii) wherein the second solvent comprises toluene, methyl isobutyl ketone, or a combination thereof; iii) a combination of i) and ii); or iv) wherein the first solvent comprises propylene and the second solvent comprises acetone.

Embodiment 5

The method of any of the above embodiments, wherein performing solvent dewaxing comprises: filtering the dewaxing mixture at the filtration temperature to form a first portion of the dewaxed oil and the wax cake; and washing the wax cake with the dewaxing solvent to form a wash portion of the dewaxed oil.

Embodiment 6

The method of Embodiment 5, wherein washing the wax cake comprises washing the wax cake at a wash temperature, the dewaxing solvent being miscible with the feedstock at the wash temperature.

Embodiment 7

The method of any of Embodiments 4-6, wherein filtering the dewaxing mixture comprises filtering the dewaxing mixture in at least a first filter stage and a second filter stage; and washing the wax cake comprises washing a first wax cake associated with the first filter stage and washing a second wax cake associated with a second filter stage, the method optionally further comprising a) wherein washing the first wax cake comprises washing the first wax cake at a first wash temperature, the dewaxing solvent being miscible with the feedstock at the first wash temperature; b) wherein washing the second wax cake comprises washing the second wax cake at a second wash temperature, the dewaxing solvent being miscible with the feedstock at the second wash temperature; or c) a combination of a) and b).

Embodiment 8

The method of any of Embodiments 4-7, wherein the wash temperature is greater than the filtration temperature by 2° C. to 15° C. (or 2° C. to 10° C., or 2° C. to 5° C.).

Embodiment 9

The method of any of the above embodiments, wherein the dewaxing mixture further comprises 50 vppm to 2000 vppm (or 100 vppm to 1000 vppm, or 50 vppm to 500 vppm, or 100 vppm to 500 vppm) of a dewaxing aid, the dewaxing aid optionally comprising poly(alkyl methacrylate).

Embodiment 10

The method of any of the above embodiments, wherein the solvent dewaxing comprises continuous rotary drum vacuum filtration.

Embodiment 11

The method of any of the above embodiments further comprising determining a miscibility curve for dewaxing solvent.

Embodiment 12

The method of Embodiment 11, wherein determining the miscibility curve for the dewaxing solvent comprises determining a miscibility curve for the dewaxing solvent based on the feedstock.

Embodiment 13

The method of any of the above embodiments, wherein a difference between a pour point of the dewaxed oil and the filtration temperature is 2.0° C. or less.

Embodiment 14

The method of any of the above embodiments, wherein the feedstock comprises a kinematic viscosity at 100° C. of 3.0 cSt or more (or 8.0 cSt or more, or 16 cSt or more); or wherein the dewaxed oil comprises a viscosity index of 80 or more; or a combination thereof.

Embodiment 15

A dewaxed oil made according to the method of any of Embodiments 1-14.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

The invention claimed is:

1. A method for performing solvent dewaxing, comprising:

mixing a dewaxing solvent comprising a first solvent and a second solvent with a feedstock at a volume ratio of dewaxing solvent to feedstock of 1.5:1 to 6:1 to form a dewaxing mixture; and performing solvent dewaxing on the dewaxing mixture at a filtration temperature to form a dewaxed oil and a wax cake, an amount of the first solvent in the dewaxing solvent being beyond a miscibility point at the filtration temperature, the filtration temperature being below a miscibility temperature of the dewaxing solvent, wherein performing solvent dewaxing comprises:

filtering the dewaxing mixture at the filtration temperature to form a first portion of the dewaxed oil and the wax cake; and washing the wax cake at a wash temperature with the dewaxing solvent to form a wash portion of the dewaxed oil, the dewaxing solvent being miscible with the feedstock at the wash temperature, the wash temperature being greater than the filtration temperature by 2° C. to 15° C.

2. The method of claim 1, wherein filtering the dewaxing mixture comprises filtering the dewaxing mixture in at least a first filter stage and a second filter stage, and washing the wax cake comprises washing a first wax cake associated with the first filter stage and washing a second wax cake associated with a second filter stage.

3. The method of claim 2, a) wherein washing the first wax cake comprises washing the first wax cake at a first wash temperature, the dewaxing solvent being miscible with the feedstock at the first wash temperature;

b) wherein washing the second wax cake comprises washing the second wax cake at a second wash temperature, the dewaxing solvent being miscible with the feedstock at the second wash temperature; or c) a combination of a) and b).

4. The method of claim 1, wherein the first solvent and the second solvent are selected from aliphatic ketones comprising 3-6 carbons, autorefrigerant hydrocarbons, $C_2$-$C_4$ chlorinated hydrocarbons, and single-ring aromatics.

5. The method of claim 4,

A) wherein the aliphatic ketones comprise acetone, methyl ethyl ketone, methyl isobutyl ketone, or a combination thereof;

B) wherein the autorefrigerant hydrocarbons comprise propylene;

C) wherein the single-ring aromatics comprise benzene, toluene, xylene, or a combination thereof;

D) wherein the $C_2$-$C_4$ chlorinated hydrocarbons comprise dichloromethane, dichloroethane, or a combination thereof; or E) a combination of two or more of A), B), C), and D).

6. The method of claim 1, i) wherein the first solvent comprises methyl ethyl ketone;

ii) wherein the second solvent comprises toluene, methyl isobutyl ketone, or a combination thereof;

iii) a combination of i) and ii); or iv) wherein the first solvent comprises propylene and the second solvent comprises acetone.

7. The method of claim 6, wherein, when, the first solvent comprises methyl ethyl ketone, an amount of methyl ethyl ketone is beyond the miscibility point at the filtration temperature by 0.1 vol % to 5.0 vol %.

8. The method of claim 1, the amount of the first solvent is beyond the miscibility point at the filtration temperature by 0.1 vol % to 5.0 vol %.

9. The method of claim 1, wherein the dewaxing mixture further comprises 50 vppm to 2000 vppm of a dewaxing aid.

10. The method of claim 9, wherein the dewaxing aid comprises poly(alkyl methacrylate).

11. The method of claim 1, wherein the dewaxing mixture further comprises 100 vppm to 500 vppm of a dewaxing aid.

12. The method of claim 1, wherein the solvent dewaxing comprises continuous rotary drum vacuum filtration.

13. The method of claim 1, further comprising determining a miscibility curve for the dewaxing solvent.

14. The method of claim 13, wherein determining the miscibility curve for the dewaxing solvent comprises determining a miscibility curve for the dewaxing solvent based on the feedstock.

15. The method of claim 1, wherein a difference between a pour point of the dewaxed oil and the filtration temperature is 2.0° C. or less.

16. The method of claim 1, wherein the feedstock comprises a kinematic viscosity at 100° C. of 8.0 cSt or more.

17. The method of claim 1, wherein the dewaxed oil comprises a viscosity index of 80 or more.

18. A method for performing solvent dewaxing, comprising:

mixing a dewaxing solvent comprising a methyl ethyl ketone and a second solvent with a feedstock at a volume ratio of dewaxing solvent to feedstock of 1.5:1 to 6:1 to form a dewaxing mixture; and performing solvent dewaxing on the dewaxing mixture at a filtration temperature to form a dewaxed oil and a wax cake, an amount of the methyl ethyl ketone in the dewaxing solvent being beyond a miscibility point at the filtration temperature by 0.1 vol % to 5.0 vol %, the filtration temperature being below a miscibility temperature of the dewaxing solvent, wherein performing solvent dewaxing comprises:

filtering the dewaxing mixture at the filtration temperature to form a first portion of the dewaxed oil and the wax cake; and washing the wax cake at a wash temperature with the dewaxing solvent to form a wash portion of the dewaxed oil, the dewaxing solvent being miscible with the feedstock at the wash temperature, the wash temperature being greater than the filtration temperature by 2° C. to 15° C.

19. The method of claim 18, wherein a difference between a pour point of the dewaxed oil and the filtration temperature is 2.0° C. or less.

20. The method of claim 18, wherein the wash temperature is greater than the filtration temperature by 2° C. to 5° C.

* * * * *